US006513602B1

(12) United States Patent
Lewis et al.

(10) Patent No.: US 6,513,602 B1
(45) Date of Patent: Feb. 4, 2003

(54) GAS GENERATING DEVICE

(75) Inventors: Donald J. Lewis, Scottsdale, AZ (US); Donald E. Olander, Tempe, AZ (US); Michael C. Magenot, Phoenix, AZ (US)

(73) Assignee: Universal Propolsion Company, Phoenix, AZ (US)

( * ) Notice: Subject to any disclaimer, the term of this patent is extended or adjusted under 35 U.S.C. 154(b) by 0 days.

(21) Appl. No.: 09/661,224

(22) Filed: Sep. 13, 2000

(51) Int. Cl.[7] ..... A62C 35/00

(52) U.S. Cl. ..... 169/84; 169/12; 149/19.1; 252/2

(58) Field of Search ..... 169/11, 12, 46, 169/47, 84; 149/19.1, 19.3, 2; 222/3; 252/2–8

(56) References Cited

U.S. PATENT DOCUMENTS

| | | | | | |
|---|---|---|---|---|---|
| 2,719,589 | A | | 10/1955 | Mapes | |
| 4,319,640 | A | | 3/1982 | Brobeil | |
| 4,406,797 | A | * | 9/1983 | Altman et al. | 169/47 X |
| 5,449,041 | A | | 9/1995 | Galbraith | |
| 5,466,386 | A | * | 11/1995 | Stewart et al. | 252/2 |
| 5,520,826 | A | * | 5/1996 | Reed, Jr. et al. | 252/5 |
| 5,562,861 | A | * | 10/1996 | Nimitz et al. | 252/2 X |
| 5,626,786 | A | * | 5/1997 | Huntington et al. | 169/46 |
| 5,848,716 | A | | 12/1998 | Birk | |
| 5,861,106 | A | | 1/1999 | Olander | |
| 5,884,710 | A | | 3/1999 | Barnes et al. | |
| 5,988,438 | A | * | 11/1999 | Lewis et al. | 222/3 |
| 5,992,528 | A | | 11/1999 | Parkinson et al. | |
| 6,019,177 | A | | 2/2000 | Olander | |

* cited by examiner

*Primary Examiner*—Steven J. Ganey
(74) *Attorney, Agent, or Firm*—Jerry Holden; John D. Titus

(57) ABSTRACT

A method and a device for producing a sufficient quantity of a fire suppressing gaseous product to substantially suppress a fire. The device has a first stage gas source containing a pyrotechnic gas generating material and a second stage gas source in fluid communication at a first location with an outlet of the first stage gas source and, at a second location, with an outlet for dispersing gas. The second stage gas source contains at least one liquified gas or supercritical carbon dioxide, where the first stage gas source is capable of providing a sufficient quantity of gas at a sufficiently high temperature to vaporize at least a portion of the liquified gas or supercritical carbon dioxide in the second stage gas source, thereby producing a fire suppressing gaseous output, which exits the device through the outlet for dispersing gas, in an amount sufficient to at least partially suppress a fire. At least one of the pyrotechnic gas generating material, the liquified gas, and the supercritical carbon dioxide is mixed with or includes at least one fire suppressant material selected from the group consisting of elemental halogens and alkali metal halides.

14 Claims, 5 Drawing Sheets

FIG. 4
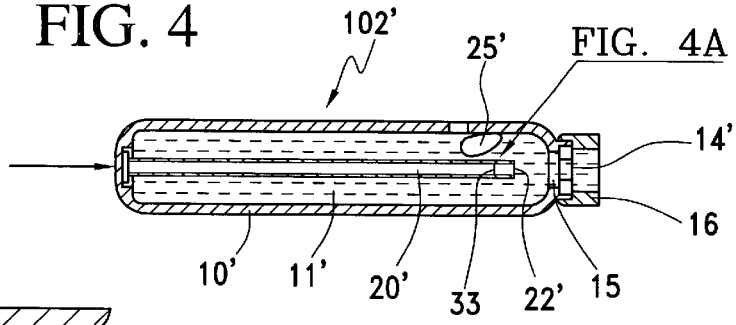
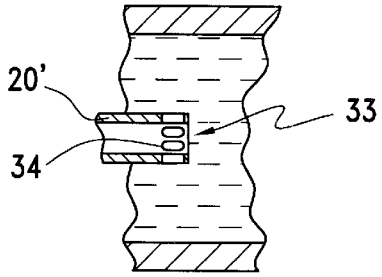
FIG. 4A
FIG. 5
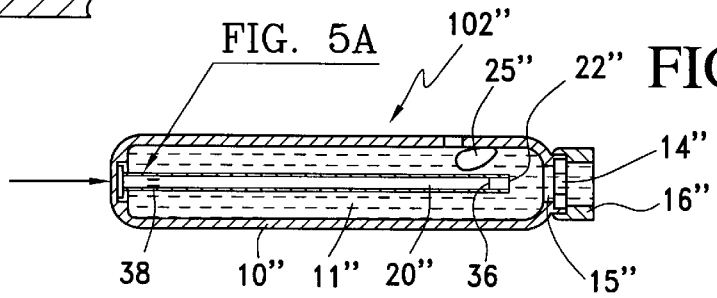
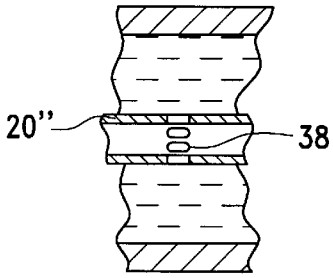
FIG. 5A
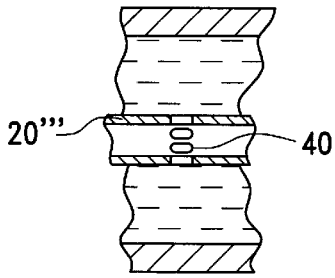
FIG. 6A
FIG. 6
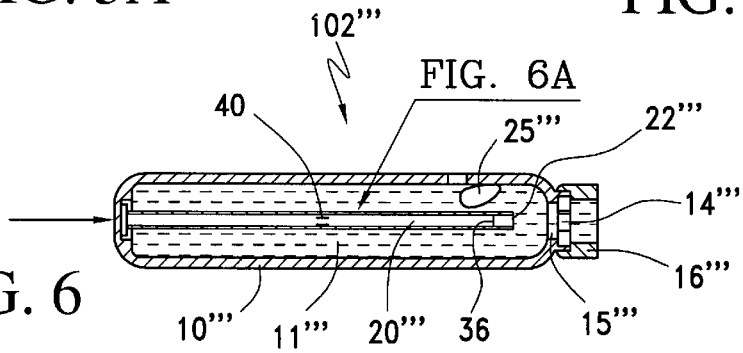

GAS GENERATING DEVICE

FIELD OF THE INVENTION

The present invention is directed to gas generators and to methods of generating a gas. In particular, the invention is directed to gas generators that may be used in any application requiring the relatively rapid generation of a gas, such as, e.g., inflation devices, fire suppression devices, and propulsion devices.

BACKGROUND OF THE INVENTION

Gas generators are useful in many applications, including the inflation of inflatable objects, such as, e.g., aircraft escape slides, life rafts, and vehicular passive restraints, i.e., air bags and inflatable seat belts. Gas generators are also used as propulsion devices, such as rocket and jet engines, which release a large quantity of hot gas at high speed, producing thrust. Gas generators have also been found to be useful as fire extinguishers and fire suppression devices.

There are three generic types of gas generators: pressurized gas, pure pyrotechnic, and hybrid. Pressurized gas gas generators produce 100 percent of the generated gas from a stored pressurized gas, while pyrotechnic gas generators produce all of the gas from the combustion of a solid, liquid, or gaseous pyrotechnic material. Hybrid gas generators use the combustion of a pyrotechnic material to heat and expand a pressurized gas, and may produce a portion, typically from less than 10 percent to over 90 percent, of the generated gas from combustion products produced by the combustion of the pyrotechnic material.

Pressurized gas gas generators provide the coolest gas, and have a gas flow rate that can be regulated with time. Pressurized gas generators, such as, e.g., carbon dioxide fire extinguishers, typically comprise a tank containing a compressed or liquefied gas, a valve to maintain the compressed or liquefied gas within the tank during storage and for releasing the gas when needed, an outlet, and means for directing the released gas, such as a nozzle or conduit. As a result, pressurized gas gas generators tend to be large and heavy, and are often expensive. In addition, as a gas cools as it expands, pressurized gas gas generators may freeze up before all of the gas is released. Where the gas is carbon dioxide, a substantial portion of the gas may not be released, as the gas becomes sufficiently cold to produce solid dry ice within the tank. The storage temperature of the gas generator can also have a large effect on pressure of the stored gas, as the pressure of the gas varies directly with the absolute temperature of the gas. For example, the pressure of a given volume of gas at 0° C. is only about 73 percent of the pressure of the same volume of gas at 100° C. As a result, the rate of gas generation is significantly reduced at low temperatures, and is significantly increased at high temperatures. In addition, a gas generator designed to produce a given pressure of gas at a given temperature will produce a lower pressure of gas for the same volume at low temperatures, and a higher pressure at high temperatures.

Pure pyrotechnic gas generators comprise a housing, a pyrotechnic gas generating material, which may be a solid, a liquid, or a gas, an igniter for initiating combustion of the pyrotechnic gas generating material, and an outlet. The output of pyrotechnic gas generators is a hot gas, produced by the combustion of the pyrotechnic material, and has a temperature of at least about 1000° C., which is near the limit of thermal acceptability in many applications. In addition, the housing of such devices becomes very hot during operation, as the combustion occurs within and in contact with the housing, heating the housing. Tortuous gas paths and/or heat sinks can be and are sued to reduce the temperature of the gas and the housing. As a result, however, pyrotechnic gas generators are heavy. In addition, pyrotechnic gas generators may require filters to remove particulates and heat from the gas stream in many applications, which also adds to the weight of the device. However, pyrotechnic gas generators are smaller and lighter than pressurized gas devices. Moreover, in most applications for propulsion devices, the temperature of the gas causes a rapid expansion of the gas, helping to provide thrust.

Because of deficiencies in cost, heat, toxicity, and performance, pure pyrotechnic gas generators are replaced with hybrid gas generators in some applications. Hybrid gas generators comprise a housing, containing a pyrotechnic material and a compressed gas, which is preferably inert, an igniter for initiating combustion of the pyrotechnic material, and a sealed outlet, which maintains the compressed gas within the housing, and opens to release the gas when the pressure of the gas is increased to a predetermined pressure upon heating of the gas by the combustion of the pyrotechnic material. Hybrid gas generators vary in performance, but the best provide a clean gas that is significantly cooler than that provided by pyrotechnic devices. The best hybrid gas generators for many applications are now less expensive than pyrotechnic devices, as a result of design improvements, and are now being installed in applications where pure pyrotechnic designs were typically used, such as, e.g., steering wheel air bag inflators.

As discussed above, gas generators have been shown to be useful in fire suppression, e.g., carbon dioxide and HALON® fire extinguishers. Fire suppression is typically achieved with the use of physical and/or chemical mechanisms to extinguish flaming and non-flaming or smoldering fires. The physical mechanism involves the physical displacement of oxidizer by the fire extinguishing composition and/or the absorption of an amount of heat sufficient to lower the temperature of the combusting materials below the ignition point by the molecules of a fire extinguishing composition, either of which terminates combustion. Generally, as the number of atoms in an extinguishment molecule increases the number of degrees of vibrational freedom also increases, and, thus, the heat capacity of the molecule increases, increasing the heat removal capacity of the extinguishment molecule. Physical suppression methods are most effective when directed at the base of the fire, where the fuel for the fire is typically located.

The chemical mechanism, on the other hand, involves interruption of the free radical fire-propagation chain reactions, which generally occur in the flames of a fire. The free radical fire-propagation chain reactions are the various reactions involving molecular oxygen and free radicals such as atomic hydrogen, atomic oxygen, and hydroxyl that often produce flame as well as the heat that keeps a fire burning. It has been speculated that halogen atoms, such as atomic bromine and iodine when present in sufficient numbers, disrupt these chain-propagation reactions, terminating both the chain reactions and combustion. Halides are ranked for their fire suppression capabilities, i.e., fluorine/fluorides are assigned a value of 1, chlorides 5, bromides 10, and iodides 16. That is, iodine is 16 times more effective than fluorine/fluorides. As a result, chemical suppression methods are generally most effective when directed into the flames of a fire where the free radical fire-propagation chain reactions occur and may be terminated.

A variety of agents and techniques are currently used for fire suppression, utilizing a chemical mechanism, a physical mechanism, or a combination of chemical and mechanical mechanisms. One conventional agent is pressurized water that extinguishes solely by thermal energy absorption. Water-based devices are not suitable, however, for use on electrical or flammable-liquid fires. Carbon dioxide, $CO_2$, and dry-chemical extinguishers, now in use, typically displace oxygen and absorb thermal energy. However, dry-chemicals can leave a corrosive residue that is undesirable in many applications, such as electronic equipment. For use against grease fires, sodium bicarbonate extinguishers, potassium bicarbonate, urea-based potassium bicarbonate, and potassium chloride extinguishers are effective, but these can also leave a heavy powdered chemical residue that can damage electrical equipment. Yet another conventional fire extinguisher is the foam (AFFF or FFFP) model, which coats flammable liquids with a chemical to lower the temperature or to eliminate the oxygen supply, although these are not suitable for electrical fires [Nat'l Fire Protection Ass'n, 1995].

U.S. Army studies on halogenated agents in the 1940's resulted in the adoption of the well known HALON® family of fire suppression compositions. HALONS are currently in use as highly effective fire suppression agents—particularly in tanks, planes, ships, and heavy engines, notwithstanding that they are believed to be environmentally deleterious. Conventional halogenated agents, such as carbon tetrachloride and HALONS, e.g., bromotrifluoromethane, can provide both physical and chemical fire suppression mechanisms.

The HALONS are bromofluorocarbons ("BFCs") that are similar to chlorofluorocarbons ("CFCs") but have the formula $C_wBr_xCl_yF_z$, where W=1 or 2, Y=0 or 1, and X+Y+Z=2W+2. HALONS must be sufficiently heated and pyrolyzed by the heat of a fire to produce free radicals before they achieve sufficient firefighting efficacy. Thus, HALONS are fairly stable and tend to work best on fires with hotter temperatures. This stability can result, however, in a fire suppression efficiency of only about 5 percent for HALONS. Moreover, because of their stability, these organic compounds tend to have long atmospheric lifetimes, and can migrate to the stratosphere where they are photolyzed by ultraviolet radiation, releasing chlorine or bromine atoms that catalytically remove ozone in a series of free radical reactions. Depletion of stratospheric ozone could allow an increase in the amount of ultraviolet light to reach the surface of the earth, resulting in increases in human skin cancer and cataracts, as well as damage to crops, natural ecosystems, and materials, and various other adverse effects. In addition, HALONS may also contribute to global warming. As a result, due to their potential to remove stratospheric ozone, conventional brominated agents and other volatile halogenated alkanes are presently being eliminated from worldwide production, pursuant to the adoption of the Montreal Protocol and the Clean Air Act of 1990.

The cost of perfluorocarbons is higher, and their fire fighting performance less effective, than those of the brominated agents. In weight and volume critical situations, such as aircraft, tanks, and ships, the additional quantity required for fire suppression is unacceptable. Perfluorinated agents also have high global warming potential ("GWP") and atmospheric lifetimes estimated to be several thousand years. Therefore, their production and use is also restricted by legislation and liability concerns of current manufacturers.

In order to quantify these concerns, halogen-containing fire suppression agents are assigned an ozone-depletion potential ("ODP") that reflects their quantitative ability to destroy stratospheric ozone. The ozone depletion potential is calculated in each case relative to CFC-11 ($CFCl_3$, trichlorofluoromethane), which has been assigned a value of 1.0. Many CFCs have ODPs near 1. HALONS have higher ODPs of between about 2 and about 14, indicating a greater ozone depletion potential. There is thus a need for fire suppression compositions that overcome the drawbacks of conventional agents as discussed above.

Firefighting compositions to replace HALONS should effectively suppress fire, be relatively nontoxic, electrically nonconductive, evaporate cleanly, and have low or no environmental impact. HALONS, although they meet the first four criteria, have long atmospheric lifetimes and high ozone-depletion potentials, and, thus, are being phased out of use, as discussed above.

Although it is relatively easy to identify fire suppressing agents having one, two, or three of these properties, it is very difficult to identify agents that simultaneously possess effective fire suppression performance, non-flammability, low toxicity, cleanliness, electrical non-conductivity, miscibility with common lubricants, short atmospheric and environmental lifetimes, low or no ODP, and very low GWP. Other characteristics are desirable, such as reduced toxicity, which is another major issue in the selection of firefighting agents. For example, the toxic effects of haloalkanes include simulation or suppression of the central nervous system, initiation of cardiac arrhythmia, and sensitization of the heart to adrenaline. Inhalation of gaseous haloalkanes can cause bronchoconstriction, reduce pulmonary compliance, depress respiratory volume, reduce mean arterial blood pressure, and produce tachycardia. Long term effects can include hepatotoxicity, mutagenesis, teratogenesis, and carcinogenicity.

Furthermore, firefighting agents must also be chemically stable during storage prior to use over long periods of time, such that they are not reactive with the containment system in which they are housed, and stable as well when stored at temperatures of about −20° C. to about 100° C., while decomposing at the higher temperatures in or near a fire to yield radical-trapping species.

A variety of alternative agents containing halides are known for fire suppression, although they are either less effective than HALONS or lack one of the characteristics desired in fire suppression agents as described above. Some of these methods and agents are discussed below. For example, one neat iodinated agent, trifluoroiodomethane, $CF_3I$, has long been known to have firefighting potential [Dictionary of Organic Compounds, Chapman and Hall, N.Y., p. 5477 (1982)].

U.S. Pat. No. 2,818,381 discloses the use of methyl bromide for extinguishing fires. This reference also discloses another early fire extinguishing composition having 10–40 parts by weight of a chloro-difluoromethane with between one and two chlorine atoms and 90 to 60 parts by weight of a mixture of bromoform and ethyl bromide.

U.S. Pat. No. 3,779,825 discloses a solid propellant composition having 60 to 90 weight percent oxidizer component selected from solid inorganic oxidizing salts of ammonium perchlorate, the alkali metal perchlorates, ammonium nitrate, the alkali metal nitrates, and mixtures thereof, at least a major portion of the oxidizer being of the perchlorates; from 10 to 40 weight percent of a binder of a rubbery material; and from 0.1 to 8 weight percent of a burning rate depressing agent.

U.S. Pat. No. 4,406,797 to Altman et al. discloses a fire extinguishing composition having a mixture of finely divided aluminum compound and an alkali metal, stannous or plumbous halide. The metal halide may include an alkali metal, e.g., potassium iodide, bromide, or chloride, or stannous or plumbous iodide, bromide or chloride, although potassium iodide is disclosed to be preferred for use in the composition.

U.S. Pat. No. 5,466,386 to Stewart et al. discloses fire-extinguishing compositions of low ozone depletion potential having dry particles of ammonium bromide coated with a water repelling, solid, non-flammable adherent, such as zinc stearate, to improve flowability. The particles allegedly enhance the fire-extinguishing properties of chlorofluorocarbons and halogenated paraffins having low ozone depletion properties when dispersed therein.

U.S. Pat. No. 5,520,826 to Reed, Jr., et al. discloses a fire extinguishing pyrotechnic having an azido binder, such as a glycidyl azide polymer (GAP), an azido plasticizer, a solid tetrazole, and a perfluorocarboxylic acid salt cured to a rubbery composite by the addition of an isocyanate that flamelessly deflagrates to produce primarily nitrogen, carbon dioxide, and a fluoroolefin.

U.S. Pat. No. 5,562,861 to Nimitz et al. discloses a set of environmentally safe, nonflammable, low-toxicity refrigerants, solvents, foam blowing agents, propellants, and firefighting agents that allegedly have no ozone-depletion potential. These agents include at least one fluoroiodocarbon agent of the formula $C_aH_bBr_cCl_dF_eI_fN_gO_h$, where a is 1 to 8; b is 0 to 2; c, d, g, and h are each 0 to 1; e is 1 to 18; and f is 1 to 2. This reference also notes that conventional chemical wisdom indicates that iodine-containing organic compounds are too toxic and unstable to use for these purposes, and iodocarbons have been rejected on those grounds by the majority of those skilled in the art.

U.S. Pat. No. 5,626,786 to Huntington et al. discloses a class of fire suppressant compounds having labile bromine atoms bound to non-carbon atoms that are alleged to be more effective than HALON® 1211 and 1301 at suppressing fires. These compounds are disclosed to hydrolyze or oxidize rapidly in the troposphere, thereby having minimal ODP.

U.S. Pat. Nos. 5,861,106 and 6,019,177 to Olander disclose compositions and methods for suppressing fires using the disclosed compositions, where the compositions comprise an organic binder, having a heat of formation of less than about 200 cal/g, and an inorganic halogen containing component, such as potassium or ammonium bromide, bromate, iodide, or iodate.

U.S. Pat. No. 5,449,041 to Galbraith discloses an apparatus and method for suppressing a fire that is less environmentally hazardous than the use of Halon®. A gas generator is used to produce a first gas at an elevated temperature containing carbon dioxide, water vapor, and/or nitrogen. The first gas is then used to vaporize a liquid, such as water, liquified carbon dioxide, or a fluorocarbon, to produce a gas having fire suppressing capabilities.

Reduction of toxicity, ODP, and other environmental effects must be balanced against effective fire suppression to achieve a superior fire suppression composition and method. Although more recent fire suppression compositions, such as those disclosed by Olander, have significantly reduced ozone depletion potential, improvements in fire suppression effectiveness are still desirable. Therefore, a need exists for improved devices and methods for delivering an environmentally-friendly, nontoxic fire suppressant that provides better fire suppression effectiveness than presently available fire suppression devices and agents. The present invention clearly meets this long-felt need in the manner and for the reasons described herein.

SUMMARY OF THE INVENTION

The invention is directed to gas generating devices, such as e.g., inflators, propulsion devices, and fire suppression devices. In a first embodiment, the gas generating devices of the invention comprise a first stage gas source and a second stage gas source. The first stage gas source has an outlet, and contains a pyrotechnic gas generating material, which, upon combustion, produces a quantity of gaseous combustion products. Optionally, the first stage gas source contains a compressed gas.

The second stage gas source contains at least one of a liquefied gas or supercritical carbon dioxide, is in fluid communication at a first location with the outlet of the first stage gas source, and comprises an outlet for dispersing gas. The first and second stage gas sources are configured and adapted such that, upon release of gas from the outlet of the first stage gas source at the first location, at least a portion of gas produced by the first stage gas source is introduced into the second stage gas source at a location within the liquefied gas or supercritical carbon dioxide. The first stage gas source is capable of providing a sufficient quantity of gas at a sufficiently high temperature to vaporize at least a portion of the liquefied gas or increase the pressure of the supercritical carbon dioxide in the second stage gas source, thereby increasing the pressure within the second stage gas source, and releasing gas from the outlet of the second stage gas source.

Where the first stage gas source is a hybrid gas generating device, the first stage further comprises a first stage housing defining a first interior volume, and having an inner surface, and contains a pressurized gas at a first pressure in the first interior volume. An igniter in thermal contact with the pyrotechnic material is used for initiating combustion of the pyrotechnic material, and a first stage seal seals the first stage outlet. The first stage seal is adapted to maintain the pressurized gas at the first pressure within the first interior volume, and to open when the gas attains a predetermined second, higher pressure upon combustion of the pyrotechnic material located within the first stage housing to allow the gas to pass from the first stage housing through the first stage outlet into the second stage gas source.

The second stage gas source preferably comprises a second stage housing defining a second interior volume, an inlet, and gas directing means for directing a quantity of gas from the first stage gas source to a predetermined location within the second stage gas source, where the inlet is in fluid communication with the outlet of the first stage gas source and the gas directing means to allow gas to pass from the first stage gas source to the predetermined location within the second stage gas source.

Preferably, the gas directing means comprises at least one metering tube, extending within the interior volume of the second stage housing from the second stage gas source inlet to direct gas from the first stage gas source into the interior volume of the second stage gas source. The at least one metering tube is preferably adapted to direct the gas from the first stage gas source to a location within the interior volume of the second stage housing proximate to the inlet of the second stage gas source.

Wherein the second stage gas source contains a liquefied gas, the liquefied gas preferably comprises at least one of nitrogen and carbon dioxide, and, more preferably, comprises carbon dioxide and up to about 25 mole percent nitrogen.

Useful pyrotechnic gas generating materials comprise a nitrate or perchlorate oxidizer and an energetic fuel, such as, e.g., RDX, HMX, CL-20, TEX, NQ, NTO, TAGN, PETN, TATB, TNAZ, and mixtures thereof.

When the gas generating device is adapted for use as a fire suppressing device, at least one of the pyrotechnic gas generating material and the liquefied gas or the supercritical carbon dioxide is mixed with or includes at least one fire suppressant material selected from the group consisting of elemental halogens and alkali metal halides, where the fire suppressant material is preferably at least one of elemental iodine and potassium bromide. Preferably, the fire suppressant material is coated or encapsulated with a protectant material adapted to prevent reaction of the fire suppression material with the pyrotechnic material, liquefied gas, or supercritical carbon dioxide. Suitable coatings include, but are not limited to epoxies, polyurethanes, polyesters, and cellulose acetate.

The pyrotechnic gas generating material preferably comprises a pyrotechnic fire suppression material, such as those disclosed in U.S. Pat. Nos. 5,861,106 and 6,019,177 to Olander. Such fire suppression materials comprise an inorganic halogen-containing component and an organic binder system, and may further comprise an elemental halogen, such as iodine. The inorganic halogen-containing component is preferably selected from the group consisting of potassium bromide, potassium bromate, potassium iodide, potassium iodate, ammonium bromide, ammonium bromate, ammonium iodide, ammonium iodate, and mixtures thereof. In addition, the organic binder preferably has a heat of formation of less than about 200 cal/g. Such as pyrotechnic fire suppression composition is solid at a temperature below 100° C., when cured, and combusts at a temperature between about 160° C. to 1200° C. to produce one or more reaction products that suppress fire, such as , e.g., $H_2O$, CO, Kl, KBr, $H_2$, $COH_2$, $O_2$, $I_2OH$, $K_2l$, and mixtures thereof.

The organic binder system comprises a binder resin of at least one curing binder, melt cast binder, solvated binder, or a mixture thereof, a curative present in about 1 to 3 weight percent, and a plasticizer present in about 10 to 30 weight percent, based on the total weight of the binder system, where the organic binder system has a heat of formation of less than about 200 cal/g. Preferably, the binder resin is selected from the group consisting of carboxy-terminated polybutadiene, polyethylene glycol, polypropylene glycol, hydroxy-terminated polybutadiene, polybutadiene acrylonitrile, polybutadiene acrylic acid, butacene, glycol azido adipate, polyglycol adipate, and mixtures thereof. The organic binder system may further comprise at least one of a curing or bonding agent, an antioxidant, an opacifier, and a scavenger.

In a further embodiment, the invention is directed to a gas generating device, adapted for producing a sufficient quantity of a gaseous fire suppressing material to substantially suppress a fire. The device comprises a first stage gas source containing a pyrotechnic, gas generating, fire suppression composition, which, upon combustion, produces a fire suppressing gas, and, optionally, a pressurized gas, where the pyrotechnic, gas generating, fire suppression composition comprises an inorganic halogen-containing component, an organic binder system, and at least one elemental halogen. Preferably, the at least one elemental halogen is elemental iodine or elemental bromine, which is more preferably coated or encapsulated with a protectant material adapted to prevent reaction with the pyrotechnic composition.

The inorganic halogen-containing compound is preferably present in an amount of from about 70 to 96 weight percent and the organic binder system is present in an amount of from about 4 to 30 weight percent, based on the total weight of the pyrotechnic composition, and the inorganic halogen-containing component is preferably selected from the group consisting of potassium bromide, potassium bromate, potassium iodide, potassium iodate, ammonium bromide, ammonium bromate, ammonium iodide, ammonium iodate, and mixtures thereof. More preferably, the organic binder has a heat of formation of less than about 200 cal/g, and wherein the pyrotechnic fire suppression composition is solid at a temperature below 100° C., when cured, and combusts at a temperature between about 160° C. to 1200° C. to produce one or more reaction products that suppress fire, such as, e.g., $H_2O$, CO, Kl, KBr, $H_2$, $COH_2$, $O_2$, $I_2OH$, $K_2l$, and mixtures thereof.

The organic binder system preferably comprises a binder resin of at least one curing binder, melt cast binder, solvated binder, and a mixture thereof, a curative present in about 1 to 3 weight percent, and a plasticizer present in about 10 to 30 weight percent, based on the total weight of the binder system, where the organic binder system has a heat of formation of less than about 200 cal/g. The binder resin is preferably selected from the group consisting of carboxy-terminated polybutadiene, polyethylene glycol, polypropylene glycol, hydroxy-terminated polybutadiene, polybutadiene acrylonitrile, polybutadiene acrylic acid, butacene, glycol azido adipate, polyglycol adipate, and mixtures thereof. The organic binder system may further comprise at least one of a curing or bonding agent, an antioxidant, an opacifier, and a scavenger.

Preferably, the gas generating device further comprises a second stage gas source in fluid communication at a first location with the first stage gas source, the second stage gas source comprising an outlet, and containing at least one liquefied gas or supercritical carbon dioxide, where the first stage gas source is capable of directing a sufficient quantity of gas at a sufficiently high temperature through an outlet therein and into the liquefied gas or supercritical carbon dioxide within the second stage gas source to vaporize at least a portion of the liquefied gas or supercritical carbon dioxide in the second stage gas source. As a result, the resulting gas exits the second stage gas source through the second stage outlet and is directed at the fire. Preferably, a halogen, such as iodine, is dissolved in the liquefied gas or supercritical carbon dioxide.

The invention is further directed to method for generating gas using a gas generating device of the invention. The method comprises initiating combustion of a pyrotechnic gas generating material located within a first stage gas source, introducing gas from the first stage gas source into a liquefied gas or supercritical carbon dioxide within a second stage gas source in fluid communication with the first stage gas source, where the first stage gas source provides a sufficient quantity of gas at a sufficiently high temperature to vaporize at least a portion of the liquefied gas or to cause an increase in pressure of the supercritical carbon dioxide, and at least a portion of the gas introduced into the liquefied gas or supercritical carbon dioxide in the second stage gas source is produced by the combustion of the pyrotechnic gas generating material, vaporizing at least a portion of the liquefied gas or increasing the pressure of the supercritical carbon dioxide with the gas from the first stage gas source sufficiently to cause a release of gas from the second stage gas source and releasing an output gas from the second stage gas source through an outlet therein, the output gas comprising the vaporized gas from the second stage gas source.

The method may further comprise providing a first stage housing adapted to contain the pyrotechnic material, the housing defining a first interior volume, and having an inner surface, the first stage housing containing a pressurized gas at a first pressure in the first interior volume, and the housing having a seal adapted to maintain the pressurized gas at the first pressure within the first interior volume, and to open when the gas attains a predetermined second higher pressure, and burning the pyrotechnic material located within the housing to generate heat, thereby increasing the pressure of the pressurized gas to at least a second higher pressure to allow the gas to pass from the housing.

The method of the invention preferably comprises providing a second stage in fluid communication with the first stage, the second stage comprising a second stage housing defining a second interior volume, an inlet adapted for fluid communication with the first gas source, an outlet, and, optionally, at least one metering tube in fluid communication with the inlet and extending within the interior volume of the second stage housing for introducing the gas from the first stage gas source into an interior volume of the second stage gas source. Gas from the first stage gas source is introduced within the liquefied gas or supercritical carbon dioxide within an interior volume of the second stage gas source.

When the invention is adapted for fire suppression, the output gas from the second stage gas source into flames from a fire or onto a source of fire, thereby suppressing the fire. Preferably, at least one fire suppressant material selected from the group consisting of elemental halogens and alkali metal halides is added to at least one of the pyrotechnic material and the liquefied gas or supercritical carbon dioxide, where the at least one fire suppressant material is coated, encapsulated, or microencapsulated with a protectant material to prevent reaction with the pyrotechnic material. To enhance the fire suppression capability of the invention the gas released by the first stage gas source may be produced from the combustion of a pyrotechnic fire suppression composition, such as those discussed above.

In a further embodiment, the invention is directed to a gas generating device having multifunctional capabilities. The gas generating device comprises a first stage gas source comprising a housing defining an interior volume, the housing containing a pyrotechnic material for producing at least one of heat and gas upon combustion, an igniter for initiating combustion of the pyrotechnic material upon receipt of an initiation signal, a first stage outlet, a first stage outlet seal adapted for sealing the first stage outlet, and a first stage outlet seal opening means for opening the first stage outlet seal upon receipt of an actuation signal to allow the gas to flow from the first stage housing through the outlet, a second stage gas source in fluid communication at a first location with the first stage gas source, and having a second stage outlet at a second location, the second stage gas source containing at least one liquefied gas or supercritical carbon dioxide, and having a second stage outlet seal adapted to maintain the at least one liquefied gas or supercritical carbon dioxide within the second stage, and to open upon receipt of either an actuation signal by a second stage outlet seal opening means operatively associated with the second stage outlet seal or upon an increase in pressure within the second stage to a predetermined second stage gas pressure, to allow gas to flow from the second stage housing, and a third seal at the first location between the first and second stage gas sources adapted to open when pressure within the first stage gas source attains a predetermined first stage gas pressure upon combustion of the pyrotechnic material to allow gas from the first stage gas source to enter the second stage gas source. The first stage gas source is capable of providing a sufficient quantity of gas at a sufficiently high temperature to vaporize at least a portion of the liquefied gas or supercritical carbon dioxide in the second stage gas source.

The gas generating device may further comprise a pressurized gas at a storage pressure in the interior volume of the first stage gas source, where the first stage outlet seal and the third seal are adapted to maintain the pressurized gas at the storage pressure within the interior volume prior to combustion of the pyrotechnic material.

To generate a gas with the multifunctional gas generating of the invention, at least one of the igniter, the first stage outlet seal opening means, and the second stage seal opening means is actuated to release a gas from at least one of the first stage gas source and the second stage gas source. For example, initiation of combustion of the pyrotechnic material using the igniter produces a first gas pressure within the first stage gas source of at least the predetermined first stage gas pressure. As a result, the third seal between the first and second stage gas sources open, introducing the gas from the first stage gas source into the second stage gas source, thus vaporizing the liquefied gas or supercritical carbon dioxide within the second stage gas source. The introduction of gas from the first stage into the second stage produces a second gas pressure within the second stage of at least the predetermined second stage gas pressure to open the second stage outlet seal, thereby opening the second stage seal, and releasing a gas comprising gas from the first stage gas source and gas from the second stage gas source through the second stage outlet Alternatively, the igniter may be used to initiate of combustion of the pyrotechnic material, producing a gas pressure within the first stage gas source less than the predetermined first stage gas pressure, and actuating the first stage outlet seal opening means, thus opening the first stage outlet. Similarly, the second stage outlet seal opening means may be actuated, opening the second stage outlet, and allowing a gas to flow from the second stage gas source through the second stage outlet.

The invention may be used to suppress a fire using the multifunctional gas generating device described above by actuating at least one of the igniter, the first stage outlet seal opening means, and the second stage seal opening means to release a fire suppressing gas from at least one of the first stage gas source and the second stage gas source, and directing the fire suppressing gas at a source of fire, thereby suppressing the fire.

BRIEF DESCRIPTION OF THE DRAWINGS

FIG. 4 illustrates an alternate embodiment of a second stage gas source according to the invention, having a metering tube extending into the second stage for directing gas therein from the first stage, the metering tube provided with a perforated plug in a terminal end thereof;

FIG. 4A is an enlarged sectional view of a portion of FIG. 4 with the aperture of the gas directing means located at a first position (Position A) of the means;

FIG. 5 is a view similar to FIG. 4 illustrating an embodiment with tube perforations in the end portion of the tube opposite the terminal end of the tube extending into the second stage;

FIG. 5A is an enlarged sectional view of a portion of FIG. 5 with the aperture of the gas directing means located at a second position (Position B) of the means;

FIG. 6 illustrates a further alternate embodiment of the second stage gas source;

FIG. 6A is an enlarged sectional view of a portion of FIG. 6 with the aperture of the gas directing means located at a third position (Position C) of the means;

DETAILED DESCRIPTION OF THE INVENTION

Figure 1:
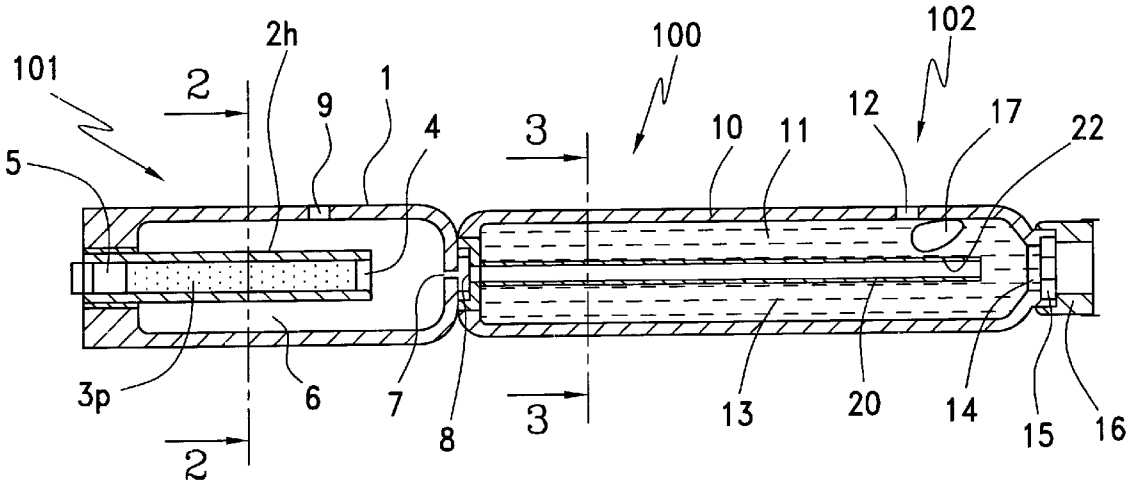
FIG. 1 is a sectional view of the apparatus of the present invention including first and second gas generating components, where the first stage is a hybrid gas generator.

As used herein, the terms "gas generator" and "gas generating device" refer to any device that rapidly generates a quantity of gas under pressure on demand.

As used herein, the terms "fire suppression", "flame suppression", and "suppression" refer to inhibiting, suppressing, or extinguishing a flaming or non-flaming fire. As will be understood by those skilled in the art, a fire may exist without flames. That is the fire may involve a smoldering material that does not produce flame, typically because of an insufficient amount of heat or oxidizer. A "fire suppression material" or a "fire suppression composition" is any material that suppresses fire by physical or chemical means, and a "pyrotechnic fire suppression material" is any material that, upon combustion, produces one or more combustion products that suppress fire.

As used herein, the term "propulsion device" refers to any device that rapidly generates a gas at a sufficiently high velocity to generate thrust.

As also used herein, the term "temperature profile" refers to the change in temperature with time of the gaseous fire suppressant output of the gas generating device of the invention.

The present invention is directed to gas generators, such as, e.g., inflators, propulsion devices, and fire suppression devices. The invention is further directed to methods of generating gas for, e.g., inflating an inflatable object, rapidly suppressing fire, or for providing thrust. In a first embodiment, the gas generator of the invention comprises a pure pyrotechnic or hybrid first stage gas source that produces a gas in an amount and at a temperature sufficient to vaporize a quantity of liquified gas located in a second stage gas source, operatively associated with the first stage gas source, when at least a portion of the gas from the first stage is introduced into the second stage at a location within the liquefied gas.

Pure pyrotechnic gas generators produce all of the output gas by combustion of a pyrotechnic gas generating composition, and may be of the type commonly used as inflators in automotive air bag passive restraint systems, in a manner well known in the art. However, pyrotechnic gas generators useful in the present invention may vary significantly in size, depending upon the application. Pyrotechnic gas generators typically comprise a housing containing a pyrotechnic material capable of generating, upon combustion, a volume of hot gas, an initiator or igniter to initiate combustion of the pyrotechnic material, and, optionally, a seal that opens at a predetermined pressure to release the pent-up hot gases, such as a rupturable diaphragm, pop-off valve, a pressure sensor and electronically actuated valve, or other means known in the art. Upon receiving an appropriate signal, the initiator causes the pyrotechnic material to burn, generating a hot gas for mixing with and thereby heating the stored gas. Where the optional seal is used, the pressure within the housing is raised to the predetermined pressure, opening the seal, and releasing the gas.

Hybrid gas generators increase the pressure of a pressurized gas within the generator housing using heat from the combustion of a pyrotechnic material. The increase in pressure causes a seal in the housing of the gas generator to open at a predetermined pressure releasing the gas, resulting in an output gas that is a combination of the heated pressurized gas and any combustion products formed in the combustion of the pyrotechnic material. In many applications, the hybrid gas generator is preferably a high thermal efficiency generator of the type disclosed in co-pending, co-assigned Application No. 08/587,773, filed Dec. 22, 1995, now U.S. Pat. No. 6,142,511, or in co-assigned Application No. 09/444,730 (the '730 application), filed Nov. 19, 1999, now U.S. Pat. No. 6,199,905. The contents of these references are incorporated herein by reference to the extent necessary to supplement this specification.

Pyrotechnic materials commonly useful in both pure pyrotechnic and hybrid gas generators include commonly available pyrotechnic propellants, such as, e.g., a mixture of at least one of ammonium nitrate, potassium nitrate. or potassium perchlorate oxidizer and an energetic fuel, such as, e.g., RDX, HMX, CL-20, TEX, NQ, NTO, TAGN, PETN, TATB, TNAZ, and mixtures thereof. Relatively hot gases produced from the combustion of the pyrotechnic material is then used to provide the gas required to vaporize the liquified gas in the second stage gas source.

In one embodiment of the invention, to aid in the suppression of fire by adding a source of free radicals, either or both of the pyrotechnic material used in the first stage and the liquified gas is mixed with or contains at least one of a molecular, i.e., elemental halogen, preferably iodine or bromine, and most preferably iodine, or an alkali metal halide, preferably potassium bromide or potassium iodide, most preferably potassium bromide. Halogen atoms, such as atomic bromine and iodine atoms, which are free radicals, are believed to disrupt fire-propagation chain reactions in flames from a fire, which are the various reactions involving molecular oxygen and free radicals such as atomic hydrogen, atomic oxygen, and hydroxyl that produce fire, and produce the heat that keeps a fire burning, thus terminating the chain reactions and preventing combustion. As a result, the fire suppressing gas produced with the invention rapidly suppresses flame associated with the fire. Where reaction with the pyrotechnic material is a concern during long-term storage, the halogen or halide may be coated, encapsulated, or microencapsulated with a non-reactive material in a manner well known in the art before insertion into or mixing with the pyrotechnic material. Suitable coatings include, but are not limited to epoxies, polyurethanes, polyesters, and cellulose acetate.

Preferably, for use in fire suppression devices, the pyrotechnic material is a fire suppressant composition, i.e., a composition that, upon combustion, produces gaseous fire-suppressing byproducts with or without the addition of halogens or halides. The gaseous fire-suppressing byproducts suppress fire by excluding oxygen and/or by actively interfering with the fire propagation chain reactions. The production of free radicals from the combustion of a fire suppression material may be augmented by the addition of a halide or elemental halogen, as discussed above.

Most preferably, for use in fire suppression devices, the pyrotechnic material is a pyrotechnic fire suppressant composition of the type disclosed in U.S. Pat. Nos. 5,861,106 and 6,019,177 to Olander ("the Olander patents"), the teachings of which are expressly incorporated herein by reference in their entirety. The fire suppression compositions disclosed by Olander comprise an inorganic halogen-containing component comprising bromine, iodine, or a mixture thereof, and an organic binder system, preferably having a heat of formation of less than about 200 cal/g, where the composition is solid at a temperature below 100° C., when cured, and combusts at a temperature between about 160° C. to 1200° C. to produce a plurality of reaction products, which are preferably gaseous, and which typically comprise $H_2O$, CO, Kl, KBr, $H_2$, $COH_2$, $O_2$, $I_2OH$, $K_2l$, and mixtures thereof, that suppress fire. The reaction products may undergo various chemical reactions in the fire, such that substantially all of the halogen is converted into a solid form after suppressing the fire or leaving the region of the flames produced by the fire, which facilitates cleanup once the fire is out.

Inorganic halogen-containing components taught by Olander that are useful in the invention include, e.g., potassium bromide, potassium bromate, potassium iodide, potassium iodate, ammonium bromide, ammonium bromate, ammonium iodide, ammonium iodate, and mixtures thereof. Preferably, the inorganic halogen-containing component is potassium iodate, potassium bromate, potassium bromide, ammonium iodate, or a mixture thereof.

The organic binder system taught by Olander comprises a binder resin of at least one curing binder, melt cast binder, solvated binder, or a mixture thereof, a curative present in about 1 to 3 weight percent, and a plasticizer present in about 10 to 30 weight percent, where the organic binder system has a heat of formation of less than about 200 cal/g. The binder resin is preferably carboxy-terminated polybutadiene, polyethylene glycol, polypropylene glycol, hydroxy-terminated polybutadiene, polybutadiene acrylonitrile, polybutadiene acrylic acid, butacene, glycol azido adipate, polyglycol adipate, or a mixture thereof. The organic binder system may further comprise at least one of a curing or bonding agent, an antioxidant, an opacifier, and a scavenger.

The fire suppressing properties of the pyrotechnic propellant in a pyrotechnic first stage source may also be improved by adding a source of free radicals. As the compositions taught by Olander comprise a halide, the propellant preferably further comprises an elemental halogen, which is preferably iodine or bromine, and most preferably iodine, to improve its fire suppressing properties. Again, where reaction between the elemental halogen and the propellant may cause a degradation of the propellant during storage, coating, encapsulating, or microencapsulating the halide or halogen by any means known in the art is desirable. The halide or elemental halogen is preferably coated, encapsulated, or microencapsulated with a non-reactive material in a manner well known in the art before insertion into or mixing with the pyrotechnic material. Suitable coatings include, but are not limited to epoxies, polyurethanes, polyesters, and cellulose acetate.

The liquefied gas in the second stage gas source, when vaporized or released, exits the second stage component with the output of the first stage gas source in a gaseous form. The output gas may be used in any application where a relatively cool gas is required, such as, e,g., as an inflation gas, to provide thrust for a propulsion device, or as a fire extinguishing gas. Preferably, the liquefied gas in the second stage cools the output of the first stage gas source. The first and second stage gas sources are in fluid communication, such that, gas produced in the first stage may be introduced into the liquified gas in the second stage gas source, as described below, thereby vaporizing the liquified gas, and increasing the pressure within the second stage gas source. When the pressure within the second stage gas source is increased, a seal in the second stage gas source opens, allowing the gas produced by the first stage and the vaporized gas from the second stage to exit from the gas generator of the invention. The first and second stage gas sources may be of the type disclosed in U.S. Pat. No. 5,988,438 to Lewis et al., the teachings of which are incorporated by reference to the extent necessary to supplement this specification.

A gas generator in accordance with the present invention utilizing a hybrid first stage is shown in FIG. 1. Gas generating device 100, as illustrated in FIG. 1, comprises a hybrid gas generator as a first stage gas source 101 for producing relatively hot gas and a second stage gas source 102 containing a liquefied gas or supercritical carbon dioxide 11 for producing a relatively cool gas. In the present invention, the hybrid inflator used as first stage gas source 101 comprises a housing 1 defining a first interior volume 6, containing a pressurized gas, that is preferably inert, such as nitrogen or argon, a pyrotechnic material 3*p*, and an initiator 5, such as, e.g., a pyrotechnic squib, to initiate the combustion of pyrotechnic material 3*p*. Other useful initiators for initiating the pyrotechnic materials useful in the invention are well known in the art. The pressurized gas may be introduced into the housing through a fill port 9. A first stage seal 8 situated within a first stage outlet aperture 7 maintains the pressure of the pressurized gas within the interior volume 6, but opens when the gas attains a predetermined higher pressure upon combustion of pyrotechnic material 3*p*. The first stage seal 8 may be a rupturable diaphragm, a pop-off valve, a pressure sensor and electronically actuated valve, or any other means known in the art.

The pyrotechnic material 3*p* may be any pyrotechnic material known in the art, such as those described above, that has a rapid burn rate, i.e., typically, less than about 10 milliseconds, and may be shaped into any form that allows for the rapid combustion of the material, e.g., powder, flakes, pellets, or stick. The pyrotechnic material 3*p* may be located within a holder 2*h* optionally having an end plug 4, as shown in FIG. 1. Either or both of holder 2*h* and end plug 4 may be solid, frangible or porous, as long as the holder 2*h* and end plug 4 allow the hot gases formed from the combustion of pyrotechnic material 3*p* to readily escape from the holder 2*h* to heat the pressurized gas in volume 6, thereby increasing the pressure of the gas. However, the pyrotechnic material in the preferred first stage gas source need not be stored in a container, as shown in FIG. 1, but, instead, may be formed into a stick, applied in a thin coating over a layer of insulating material on a surface within the first stage housing 1, or in any other configuration, as would be well known in the art, that is adapted to provide the required burning rate.

As discussed above, the combustion of the pyrotechnic material 3*p* adds heat energy to the pressurized inert gas, increasing the pressure within the first stage housing 1. The first stage seal 8 opens when the pressure of the inert gas attains a predetermined higher pressure, allowing the gas from the first stage gas source 101 to expand and pass through the first stage outlet aperture 7 into the second stage gas source 102 of the inflator 100 within liquefied gas or supercritical carbon dioxide 11. This process preferably occurs in a time sufficiently short to prevent any substantial transfer of heat to the first stage housing 1.

Figure 2:
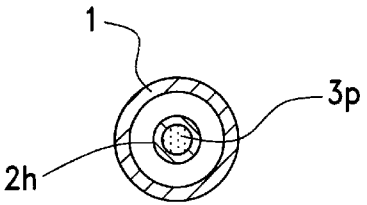
FIG. 2 is a sectional view through the first stage gas source, taken along line 2—2 of FIG. 1.
Figure 3:
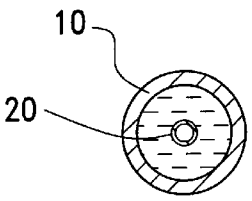
FIG. 3 is a sectional view through the second stage gas source, taken along line 3—3 of FIG. 1.

Second stage gas source 102 comprises a second housing 10, having a second interior volume 13 with an inner surface, and contains a stored liquified gas or supercritical carbon dioxide 11. Typically, where a liquefied gas is utilized, a small ullage volume 17 of non-liquified gas may be present. Although the second stage housing 10, as well as the first stage housing 1, may be cylindrical, as shown in FIGS. 1, 2, and 3, these housings may be constructed in any shape that meets the space requirements for a given application, and allows for the rapid generation of gas.

Liquified gas 11 may be any gas known in the art that may be stored in a liquid state when pressurized, and which rapidly vaporizes when heated or when the pressure on the gas is reduced. Gases that may be liquified for use in the invention, either alone or in combination, include, but are not limited to, carbon dioxide, nitrogen, and freons and halons, i.e., chlorofluorocarbons and bromofluorocarbons, which are now available commercially in forms that, unlike Freon 11, $CFCL_3$, and Freon 12, $CF_2Cl_2$, contain at least one hydrogen atom, and, thus, are chemically removed in the lower atmosphere, preventing the introduction of the chlorine and bromine atoms in the molecules into the stratosphere, and the resulting removal of ozone from the ozone layer. Preferably, the liquified gas is carbon dioxide or a mixture of carbon dioxide with up to about 25 percent nitrogen. It is important to understand that chlorofluorocarbons and bromofluorocarbons should not be used in fire suppression applications where the chlorofluorocarbons and bromofluorocarbons are subjected to high temperatures that result in the production of hydrogen fluoride. For use in fire suppression devices, liquefied gas or supercritical carbon dioxide 11 is mixed with an elemental halogen or alkali metal halide to provide additional free radicals.

Supercritical carbon dioxide is particularly useful in fire suppression devices, because of it is capable of absorbing a large quantity of elemental iodine, which provides flame suppressing free radicals when exposed to the heat of the flames. Supercritical carbon dioxide is carbon dioxide at a temperature higher than its critical temperature, $T_c$, of 31° (87.8° F.). A gas at a temperature higher than the critical temperature of the gas will not liquefy no matter how much pressure is applied to the gas.

Second stage housing 10, further comprises a gas fill port and plug 12, which may be used to monitor the pressure of the stored liquified gas or supercritical carbon dioxide 11, and a second stage outlet aperture 14 closed with a second stage seal 15. Second stage seal 15 maintains liquified gas or supercritical carbon dioxide 11 within the interior volume 13 of second stage housing 10 at a first, storage pressure, but opens when the liquified gas is vaporized or the pressure of the or supercritical carbon dioxide is increased by the introduction of relatively hot gas from first stage gas source 101, and the pressure within second stage gas source 102 increases to a predetermined higher pressure. As with first stage seal 8, second stage seal 15 may be a rupturable diaphragm, a pop-off valve, a pressure sensor and electronically actuated valve, or any other type of openable seal known in the art.

Housing 10 may also comprises an outlet 16. For a fire suppression device, outlet 16 may be used for directing the output gas at fire or the flames from a fire, such that when second stage seal 15 opens, vaporized gas flows from the interior volume 13 of second stage housing 10, either alone or in combination with gas released from first stage gas source 101, through the second stage outlet aperture 14 and out outlet 16. When the apparatus of the invention is adapted for use as a propulsion device, outlet 16 may be an expansion cone to maximize thrust.

Second stage gas source 102 also preferably comprises means for directing a quantity of gas from the first stage gas source to a predetermined location within second stage gas source 102. Preferably, this means is a metering tube 20. The diameter of metering tube 20 is typically approximately equal to that of first stage orifice 7, but may be adjusted to control the velocity of the gases in metering tube 20, depending on the application. Metering tube 20 introduces the quantity of relatively hot gas from first stage gas source 101 into liquified gas or supercritical carbon dioxide 11 within interior volume 13 of second stage housing 10. Where second stage housing 10 is cylindrical, metering tube 20 is typically concentric with the housing 10 as shown in FIGS. 1 and 3, but may be adapted to introduce the output gas from first stage gas source 101 at any point within liquified gas or supercritical carbon dioxide 11 that will provide a desired output gas temperature profile. Metering tube 20 may be either open or closed at tube end 22, and can be varied in length to extend to substantially any part in the interior of volume 13. Where tube end 22 is closed, metering tube 20 must be otherwise adapted to allow gas from first stage gas source 101 to enter interior volume 13 of second stage housing 10 to vaporize liquified gas or supercritical carbon dioxide 11. This may be accomplished by using a porous material to form metering tube 20, or by placing one or more appropriately sized holes in the walls of metering tube 20. The placement of the holes and/or the length of metering tube 20, where tube end 22 is open, may be used to control the temperature of the gas exiting the inflator.

For example, when tube end 22 is open as shown in FIG. 1 or where tube end 22 is closed, and metering tube 20 defines one or more openings 34 either near its end 22 or in a perforated plug 33, as shown in FIGS. 4 and 4A, the initial output from the second stage gas source 102 is relatively hot, followed by progressively colder gas as the liquified gas or supercritical carbon dioxide 11 vaporizes and exits through the second stage outlet aperture 14. This corresponds to temperature profile A in FIG. 7.

Figure 7:
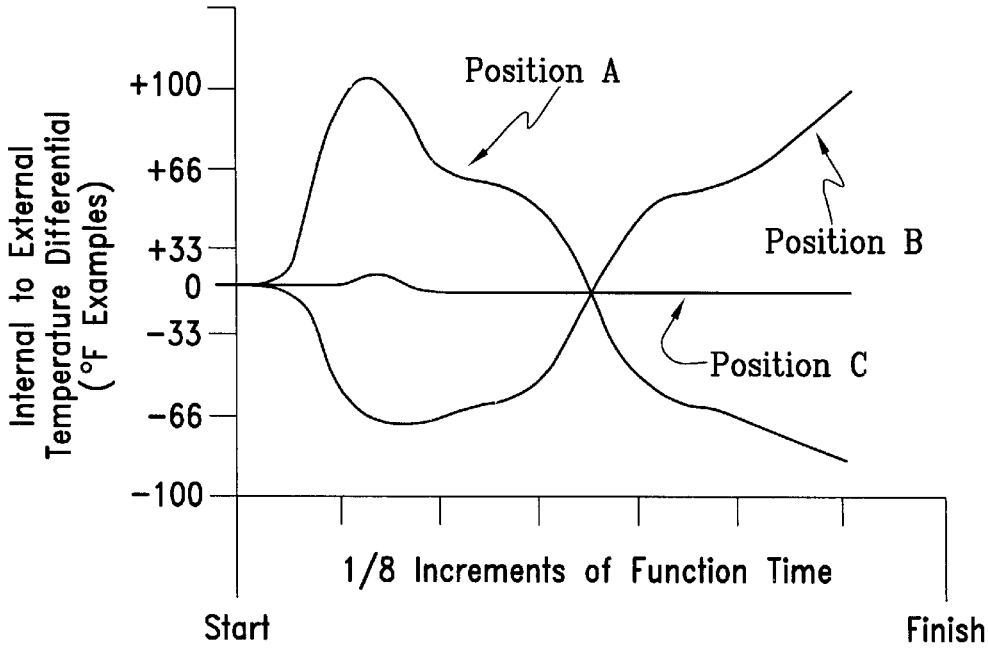
FIG. 7 is a graph of the different temperature profiles obtained by introducing the output of the first stage into three different positions within the second stage.

Alternatively, to obtain an output gas temperature profile that becomes progressively warmer as vaporized gas exits the inflator, as shown in temperature profile B in FIG. 7, the output from the first stage gas source should be introduced into the liquified gas or supercritical carbon dioxide at a location opposite second stage outlet aperture 14. This may be accomplished by using a short, open metering tube 20, or by closing end 22 of metering tube 20, typically, with a blank or solid plug 36, and providing openings 38 in metering tube 20 at the end opposite end 22, as shown in FIGS. 5 and 5A.

It is also possible to obtain an output gas having a substantially constant temperature after a short period of operation, as shown in temperature profile C, by locating the output of the metering tube 20 near the center of second stage housing 10. This is shown in FIGS. 6 and 6A, where openings 40 are located about halfway along the length of metering tube 20. This configuration is particularly useful when the gas generation device is utilized as a fire suppression device.

As will be obvious to one of ordinary skill in the art, the means for directing a quantity of relatively hot gas from the first stage gas source 101 to a predetermined location within the second stage gas source 102 may take on a variety of shapes and forms in contrast to the configuration shown, e.g., for metering tube 20 in FIGS. 1 and 3, as long as the output gas from the first stage gas source 101 is introduced into a location or locations within the second stage gas source 102 that allows for the rapid release of gas from the second stage source 102 with the desired temperature profile. For example, the gas directing means may comprise any combination of two or more of the metering tubes described above or any other means that allows the introduction of gas into a desired location within the second stage gas source. For a metering tube or tubes, holes may be positioned at various points along the length of the metering tube, or the tubes may be formed from a porous material in which the porosity is uniform or varies along the length of the metering tube 20 to provide the desired temperature profile for the output gas. The optimum configuration required for the gas directing means to provide the optimal output gas temperature profile for any particular application may be easily determined without undue experimentation.

Figure 8:
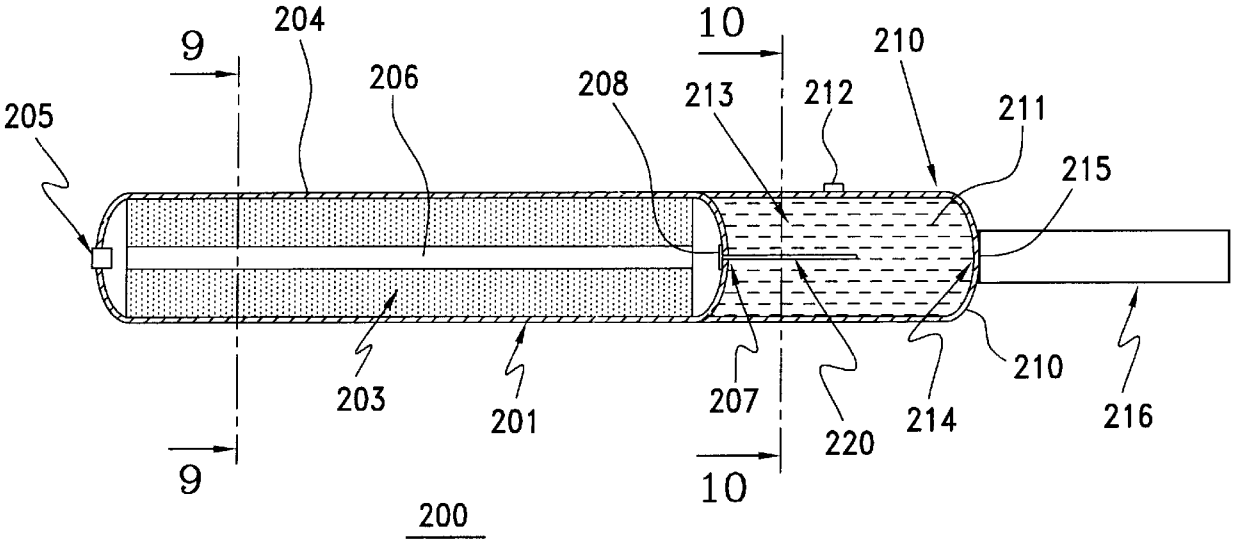
FIG. 8 is a sectional view of the apparatus of the present invention including first and second gas generating components, where the first stage is a pyrotechnic gas generator.

Another embodiment of the gas generating devices of the invention, utilizing a pyrotechnic gas generator as the first stage gas source, is generally illustrated in FIG. 8. Gas generating device 200 comprises a first stage gas source 201 adapted for producing relatively hot gas that may be a fire suppressing gas, i.e., a gas that suppresses fire by interfering with the fire-propagation chain reactions or by excluding oxygen, and a second stage gas source 202, which contains a liquefied gas 211. Second stage gas source 202, which may be adapted to be activated either independently or co-dependently with the first stage, as described below, is substantially the same as second stage gas source 102 in FIG. 1. Second stage gas source 202 preferably cools the output of first stage gas source 201, and produces a relatively cool gas having a temperature that is sufficiently low to extinguish a fire, suppress fire, and prevent a fire source from re-igniting by removing heat, thereby reducing the temperature to less than the combustion temperature.

As illustrated in FIG. 8, the pyrotechnic gas generator utilized as first stage gas source 201 comprises a housing 204 defining a first interior volume 206, which volume 206 contains a pyrotechnic material 203 and an initiator 205, such as, e.g., a pyrotechnic squib of the type disclosed in the '511 patent and the '730 application. Other initiators useful for initiating the pyrotechnic materials are well known in the art. Initiator 205 is adapted to initiate the combustion of the pyrotechnic material 203, which preferably has a rapid burn rate, i.e., typically, less than about 10 milliseconds. Pyrotechnic material 203 may be shaped into any form that allows for its rapid combustion, e.g., powder, flakes, pellets, or stick, but is preferably castable. Pyrotechnic materials useful in the invention are described above. For use in fire suppression devices, propellant 203 is preferably one of those disclosed in the Olander patents, discussed above, which are castable. More preferably, propellant 203 is one of the propellants disclosed in the Olander patents further comprising an elemental halogen to improve fire suppressing properties of the first stage output gas by providing an additional source of free radicals.

A first stage seal 208 is situated within a first stage outlet aperture 207 to maintain liquefied gas or supercritical carbon dioxide 211 within second stage gas source 202, preventing liquefied gas 211 from entering interior volume 206 of first stage gas source 201 prior to the activation of device 200. First stage seal 208 opens when the gas produced by the combustion of propellant 203 attains a predetermined pressure within interior volume 206. First stage seal 208 may be a rupturable diaphragm, a pop-off valve, a pressure sensor and electronically actuated valve, or other means known in the art that performs the required function.

Figure 10:
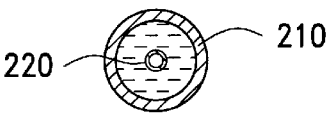
FIG. 10 is a sectional view through the second stage gas source, taken along line 10—10 of FIG. 8.
Figure 9:
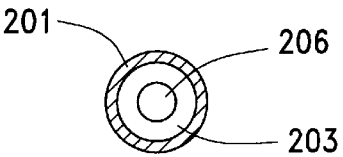
FIG. 9 is a sectional view through the first stage gas source, taken along line 9—9 of FIG. 8.

Gas from the first stage gas source 201 expands and passes through the first stage outlet aperture 207 into the second stage gas source 202 of the fire suppression device 200 in the manner described above for device 100. As with second stage gas source 102 in device 100, second stage gas source 202 comprises a second housing 210, defining a second interior volume 213, and contains stored liquified gas or supercritical carbon dioxide 211, as described above in the discussion of apparatus 100. Again, with a liquefied gas, a small ullage volume of non-liquified gas may be present. While second stage housing 210, as well as first stage housing 201, may be cylindrical, as shown in FIGS. 8, 9, and 10, in the alternative, these housings may be constructed in any shape that meets the space requirements for a given application, and allows for the rapid generation of gas.

Second stage housing 210, may further comprise a gas fill port and plug 212, which may also comprise a pressure sensor to monitor the pressure of the stored liquified gas or supercritical carbon dioxide 211, and a second stage outlet aperture 214 closed with a second stage seal 215. The second stage seal 215 maintains the liquified gas or supercritical carbon dioxide 211 within the interior volume 213 of second stage housing 210 at a first, storage pressure, but opens when the liquified gas is vaporized by the introduction of relatively hot gas from the first stage gas source 201, whereupon the pressure within the second stage gas source 202 increases to a predetermined higher pressure. As with the first stage seals 8 and 208, the second stage seal 215 may be a rupturable diaphragm, a pop-off valve, a pressure sensor and electronically actuated valve, or any other type of openable seal known in the art.

Housing 210 may also comprise an outlet 216. In applications where the apparatus is used as a fire suppression device, outlet 216 may be used for directing the output gas at fire or the flames from a fire, such that when second stage seal 215 opens, vaporized gas flows from the interior volume 213 of second stage housing 210, either alone or in combination with gas released from first stage gas source 201, through the second stage outlet aperture 214 and out outlet 216. Alternatively, when the device is used as a propulsion device, outlet 216 may be an expansion cone to maximize thrust.

As described above in the discussion of device 100, second stage gas source 202 may also comprise means for directing a quantity of gas from the first stage gas source to a predetermined location within the second stage gas source, such as metering tube 220, which typically has a diameter approximately equal to that of the first stage orifice 207, but which may be adjusted to control the velocity of the gases within the tube, depending on the application. Where the second stage housing 210 is cylindrical, metering tube 220 is typically concentric with the housing 210 as shown in FIGS. 8 and 10, but may be adapted to introduce the output gas from the first stage gas source 201 at any point within the liquified gas or supercritical carbon dioxide 211 that will provide a desired output gas temperature profile. Metering tube 220 may be of any configuration described for metering tube 20 of device 200 to provide any of the temperature profiles illustrated in FIG. 7

Again, as with device 100, the composition and temperature of the output gas from gas generating device 200 at any given time during its operation is controlled, at least in part, by the location within the second stage gas source at which the output from the first stage gas source is introduced. Thus, depending upon the location at which the gas is introduced in the second stage gas source, the gas generating device of the invention may be adapted to produce (1) an output gas having a substantially constant temperature throughout the time period during which the device functions, i.e., during the output of the gas, (2) an output gas having an initially high temperature that decreases during the output of the gas, or (3) an output gas having an initially low temperature that increases during the output of the gas. The temperature and composition of the output from the gas generating device of the invention depends on the relative amounts of gas produced by each gas source which comprises the final output.

Where the output has a substantially constant temperature during the output of the gas, the output comprises a mixture of the output from the first stage gas source and the vaporized gas, and the relative amount of each remains substantially constant during operation of the device.

Where the output has an initially high temperature that decreases during the output of the gas, the initial output from the device comprises the output from the first stage gas source as the main component. As the process proceeds, however, the composition of the output first changes to a mixture of the output from the first stage gas source and the vaporized gas. As the process producing the gas proceeds further, the output comprises the vaporized gas as the main component.

Conversely, where the output has a temperature that increases during the output of the gas, the output from the initially comprises the vaporized gas as the main component. As the process proceeds, the composition of the output changes first to a mixture of the output from the first stage gas source and the vaporized gas. Near the end of the process, the output comprises the output from the first stage gas source as the main component.

A gas generating device 200 of the invention having a pyrotechnic gas generator as a first stage gas source 201, operates as follows: initiator 205, typically a pyrotechnic squib, initiates combustion of pyrotechnic material 203 within the first stage gas source 201 producing gaseous combustion products, which may be adapted to have fire suppressing properties. Where first stage seal 208 is utilized, the pressure within interior volume 206 increase until the predetermined pressure at which first stage seal 208 opens is attained. Hot gases from first stage gas source 201 rapidly flow into the second stage gas source 202, preferably through via optional metering tube 220, and into the liquified gas or supercritical carbon dioxide stored in the second stage gas source 202, through either an open end or through the delivery ports in the optional metering tube, as described above, resulting in the vaporization of the liquified gas. The volume, temperature and pressure of gases supplied to the second stage gas source from the first stage gas source may be such that all or substantially all of the liquid gas in the second stage gas source is vaporized. These parameters are readily determinable by one of ordinary skill in the art without the need for any undue experimentation.

As noted above, as long as the output from the first stage gas source is introduced into the second stage gas source within the liquefied gas or supercritical carbon dioxide, a variety of alternative gas dispersing techniques, i.e., other than the optional metering tube, may be used to mix the gas supplied by the first stage gas source with the liquified gas or supercritical carbon dioxide in the second stage gas source, resulting in the vaporization of the liquified gas or an increase in pressure of the supercritical carbon dioxide and the discharge of the combined gases from the second stage gas source. Moreover, in applications where an initial output of a cold gas is desired, only the opening of first seal 208 to allow gas from first stage gas source 201 to flow through first stage outlet aperture 207 into second stage gas source 202 may be required to introduce gas from first stage gas source 201 into second stage gas source 202 and vaporize the liquified gas.

The hot gases dispersed into second stage gas source 202 heat the stored liquified gas, which is preferably stored at a pressure of about 700 to about 1100 psi, more preferably about 900 psi, in the second stage gas source 202, vaporizing the liquified gas or raising the pressure of the or supercritical carbon dioxide, and raising the pressure within the second stage gas source to a pressure at which the second stage seal 15 opens, preferably, at least about 3,500 psi, allowing the gases within the second stage source to expand and exit the second stage gas source through the second stage outlet aperture 214, from which they are directed to a fire.

The temperature of the output gas produced by the gas generating device is preferably no more than about 200° C., and, more preferably, no more than about 100° C. The final temperature of the output gas is controlled by the thermodynamics of the apparatus, as well as the pressure of the atmosphere into which the output of the device is directed and the amounts and compositions of the pyrotechnic material and the liquified gases stored in the first and second stage gas sources. The factors, phenomena, and conditions which effect changes in temperature, pressure, and heat transfer are set forth below.

When the pyrotechnic material within the first stage gas source is burned, gaseous combustion products and heat are produced. Where the first stage gas source is a hybrid gas generator, at least a portion of the pressurized inert gas within the first stage gas source is heated, and, thus, the pressure of the gas increases. Similarly, when the first stage gas source is a pure pyrotechnic gas generator, the release of hot gas causes an increase in pressure within the interior volume of the first stage gas source. In either case, when the pressure of the gas reaches a preselected value, the first stage seal opens, allowing the mixture of combustion gases and, in the case of a hybrid gas generator, inert gas to be isenthropically, irreversibly, and essentially adiabatically accelerated through the first stage outlet aperture. At the first stage outlet aperture, the pressure of the gas mixture from the first stage gas source is reduced to approximately half, and the gas temperature is reduced approximately ten percent.

As gases exit through the first stage outlet aperture, they accelerate to the local speed of sound in the metering tube in the second stage gas source. As no energy is added to the gas at this point, the temperature and pressure of the gas is reduced. The extended metering tube causes the sonic flow of gas to undergo a series of shocks, which partially restores the pressure and temperatures from the first stage gas source. If all motion of the gas was stopped at this point, the pressure of the gas from the first stage gas source would be essentially restored to the head end chamber conditions. However, although the process of gas passage through the first stage outlet aperture is substantially adiabatic, tests have shown that an energy loss of as much as about five percent may occur due to energy losses in the shocks, such as noise and light, resulting in the temperature only being partially restored.

As the mixture of combustion gases and inert gas passes through and out of the metering tube, the gases released by the first stage gas source are at least partially mixed with the liquefied gas stored in the second stage gas source. Although the great majority of the gas from the first stage gas source mixes, at least partially, with the liquefied gas or its vapors in the second stage gas source before exiting the second stage gas source, some of the gases released by the first stage gas source may exit the second stage gas source without mixing with the stored liquefied gas. However, this incomplete mixing does not affect the final result, although it at least partially accounts for the different temperature profiles that are obtained by using different metering tube configurations described above.

As the gases released by the first stage gas source mix with the liquefied gas, the liquified gas vaporizes, absorbing an amount of energy equal to the heat of vaporization of the gas at the temperature of the liquid. As other changes in temperature occur, heat energy is absorbed or released according to the heat capacity of the materials heated or cooled. For example, at 200° C., a gram of $CO_2$ absorbs 40 calories as it vaporizes, but, where a gram of vaporized $CO_2$ is heated by 1° C., it absorbs only 0.2 calories.

Although, in theory, the mixture of gases from the first and second stage gas sources expand without doing work, as gases exit from the second stage gas Joule-Thompson cooling results in a decrease in the temperature of the gas.

The present invention is additionally directed, in a further embodiment, to a method of producing a gas, which may be used, e.g., for inflating an inflatable object, for producing thrust for a propulsion device, or for suppressing and/or extinguishing fire. The method comprises releasing a sufficient quantity of gas from a first stage gas source into a second stage gas source containing a liquified gas or supercritical carbon dioxide at a sufficiently high temperature to vaporize at least a portion, and, preferably, substantially all of the liquified gas in the second stage gas source. Alternatively, the gas from the first stage gas source may be used to raise the pressure of supercritical carbon dioxide within the second stage gas source. In either case, at least some of the liquified gas or supercritical carbon dioxide is release to produce a gaseous output. The output may then be used for any of the applications described above, as well as any others that may readily occur to those of ordinary skill in the art.

The first and second stage gas sources, either alone or in combination, may be used to generate gas. The method of this invention further comprises selecting proper pyrotechnic materials, orifices, sizes, burst diaphragms or pop-off valves or pressure sensors and electronically actuated valves, and tubes (or other gas dispensers) to accomplish the rapid generation of gas. The nature of the application affects the amount and type of gas required.

In some fire suppression applications, the cooling of the source of fire is not required. Therefore, the use of solely the output from a first stage gas source, whether pure pyrotechnic or hybrid, which exits the first stage source through a corresponding fire suppression output operatively associated therewith may be sufficient, by itself, to suppress and/or extinguish fire. Preferably, such a gas source produces the fire suppressant gas from the combustion of a pyrotechnic gas suppressant material of the type disclosed in the Olander patents. More preferably, the gas suppressant material is that disclosed by Olander combined with an elemental halogen, as described above, which may if desired be coated, encapsulated or microencapsulated. Such a fire suppression device may be used as a "stand-alone" device, or may be a "multi-functional," i.e., multi-component gas generating device, which is adapted to produce a variety of different gaseous outputs, from the first gas source or second gas source either alone or in some combination of the two sources, as described below.

Figure 11:
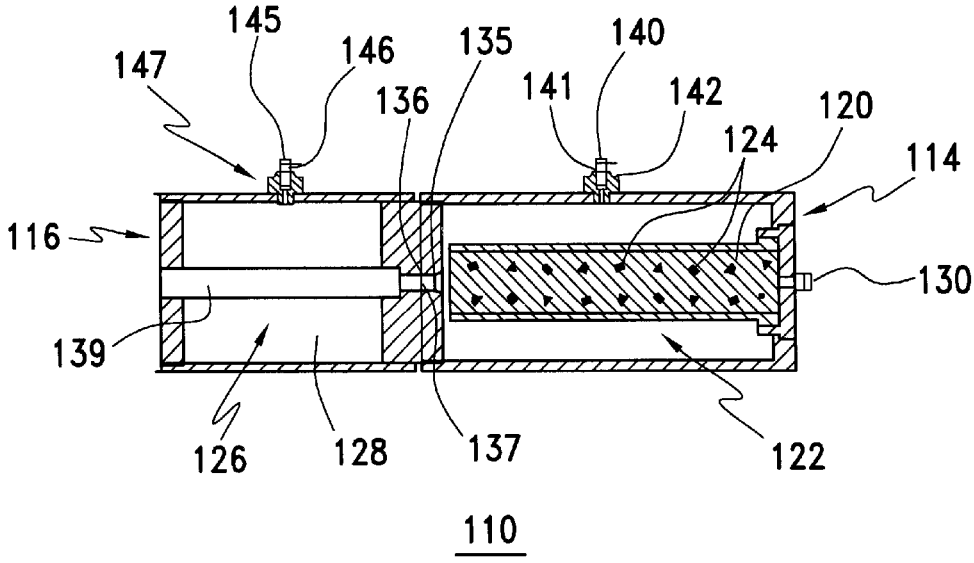
FIG. 11 illustrates a multi-functional embodiment of the gas generating device of the invention.

A multi-functional gas generating device in accordance with the invention is illustrated generally in FIG. 11. Multi-functional gas generating device 110 comprises first and second stage gas sources 114 and 116, which correspond to first and second stage gas sources 101 and 102 of device 100, as shown in FIG. 1, and a housing 118 to route the output gas to a desired location. Device 110 can provide three alternative outputs, and has selective venting capabilities, selectable internal flow paths, and multiple actuation inputs. Device 110 is particularly useful as part of a fire suppression system which incorporates a fire suppression device in accordance with the invention and one or more sensors (not shown) that provide information regarding the type of fire that must be suppressed. Therefore, the use of gas generating device 110 as a fire suppression device will be emphasized in the description below. However, it will be understood by those of skill in the art that gas generating device 110 may be used in other applications where selective outputs are desired.

First stage gas source 114, which may also be referred to as a generant section, defines an interior volume 122, containing a pyrotechnic gas generant material 120, and comprises at least one igniter 130 for initiating combustion of gas generant material 120, an outlet 140, an outlet seal 141, and an outlet seal opening means 142 for opening seal 141 to allow a gas to flow from first stage gas source 114 upon receipt of a signal from a sensor or controller (not shown). Interior volume 122 preferably also contains a pressurized inert gas such as argon or nitrogen. The use of such a pressurized inert gas facilitates regulation of the operating pressure of generant section 114 and, thus, the reaction time. Pyrotechnic material 120 may be any gas generating material known in the art, but, for use as a fire suppressant, is preferably the fire suppressant material disclosed by the Olander patents. As discussed above, pyrotechnic material 120 is preferably non-homogenous, containing an additional active fire suppressant agent 124, such as an elemental halogen or alkali metal halide, as described herein. To avoid adverse reactions between pyrotechnic material 120 and active fire suppressant agent 124, agent 124 is most preferably coated, encapsulated, or microencapsulated, such as, e.g., with an epoxy, polyurethane, polyester, or cellulose acetate.

Second stage gas source 116, which may serve as a coolant chamber, defines a second interior volume 126 in fluid communication with first interior volume 122 that is at least partially filled with a liquefied gas 128. First and second interior volumes 122 and 126 are in fluid communication through aperture 137, which, prior to operation of the device is sealed by a seal 136, such as a rupturable diaphragm, pop-off valve, a pressure sensor and electronically actuated valve, or other means known in the art. When seal 136 opens, gas from first stage gas source 114 flows through aperture 137 into metering tube 139, which directs the gas to a predetermined position within second interior volume 126, as described above. Second stage gas source 116 additionally comprises an outlet 145, an outlet seal 146, and an outlet seal opening means 147 for opening seal 146 to allow a fire suppressant gas to flow from second stage gas source 116 upon receipt of a sensor or controller (not shown).

Outlet seals 141 and 146 may be a rupturable diaphragm, valve, or other sealing means known in the art. Outlet seals 141 and 146 are operatively associated with seal opening means 142 and 147, and may form a single unit with the opening means, e.g., in the case of electronically controlled valves. Other useful seal opening means include explosive materials, which, when detonated, rupture a rupturable disk, and projectiles that are mechanically or explosively driven into a rupturable disk. Second stage outlet seal 146 must also open when the pressure within second stage gas source 116 attains a predetermined pressure upon vaporization of the liquified gas, or an additional outlet from second stage gas source opens when the predetermined pressure is attained is required to allow for all modes of operation of device 110.

The various modes of operation of device 110 that are possible with the use of igniter 130 and first and second stage outlet seal opening means 142 and 147 either alone or in a variety of combinations are described below. In a first mode, device 110 may be utilized in the same manner as device 100, as described above, providing a gas comprising a combination of gas from first and second stage gas sources 114 and 116. For example, in a fire suppression device, input from a smoke, heat, flame, or other fire sensor (not shown) may be used to activate igniter 130 causing it to ignite pyrotechnic material 120. Combustion of pyrotechnic material 120 elevates the temperature of the fire suppressant ingredients of material 120, as well as agent 124, when present, to an effective state, and additionally heats any surrounding gases as well, increasing the pressure within volume 122. This causes seal 136, which may be, e.g., a frangible disk or pop-off valve to open, allowing gas from generant section 114 to flow into coolant chamber 116, at least partially vaporizing the liquefied gas. This increases the pressure within second volume 128, causing outlet seal 146 to open, allowing the mixed gases to be directed at the fire through outlet 145.

In an alternate embodiment, rather than dispersing a fire suppressing agent within pyrotechnic material 120, the fire suppressing agent may be formed into or incorporated in an ablative structure 135, such as a ring, that is positioned in aperture 137, such that ablative structure 135 is exposed to the output of first stage gas source 114. As the relatively hot gases released from first stage gas source 114 pass over ablative structure 135, structure 135 is ablated releasing the fire suppressing agent into the output gas.

A variety of alternate modes of operation are also possible for device 110. For example, liquefied gas 128 may be dispersed alone to provide an inert, cold, heavy gas. This is particularly useful for a non-flaming fire in which a heated mass generates and maintains the fire. To release only the inert, cold, heavy gas, a signal from a smoke, heat, flame, or other fire sensor (not shown) is used to activate second stage seal opening means 147, operatively associated with second stage outlet 145, thereby opening outlet 145. The opening of second stage outlet 145 releases the pressure on liquefied gas 128, allowing the liquid to vaporize and exit through outlet 145 from which it is directed at the fire. The vaporization absorbs a large quantity of heat, substantially lowering the temperature of the liquefied gas as it vaporizes and exits device 110 through second stage outlet 145.

Similarly, pressurized gas stored in volume 122 of first stage gas source 114 may also be released alone or in combination with the coolant gas from second stage gas source 116 without igniting pyrotechnic material 120 by sending an initiation signal from a smoke, heat, flame, or other fire sensor (not shown) to activate first stage outlet seal opening means 142, operatively associated with first stage outlet 140, thereby opening outlet 140. To obtain an output that comprises the inert gas from first stage gas source 114 and the coolant from second stage gas source 116, first stage outlet seal opening means 142 and second stage outlet seal opening means 147 are used to open first stage outlet seal 141 and second stage outlet seal 146 either simultaneously or with a time delay between openings, thereby releasing the pressurized gas and the gas produced from the vaporization of the liquified gas through outlets 140 and 145 without igniting pyrotechnic material 120.

In addition, first stage gas source 114 may be operated alone to provide active free radicals such as iodine atoms from the combustion of pyrotechnic material 120. To prevent the release of coolant in this mode of operation, first state gas source output seal opening means 142 must open first stage output 140 before the pressure within volume 122 is sufficiently high to open seal 136. Actuation of first stage output seal opening means 142 may be accomplished by any means known in the art, such as, e.g., by a signal from a timing circuit or a pressure sensor within interior volume 122. An ablative structure 135 containing a fire suppression agent may also be positioned in first stage output 140 to provide additional free radicals.

As with the embodiments described above, the temperature profile, i.e., the output temperature versus dispensing time, is determined by the location at which output from the first stage gas source is introduced into the liquefied gas within the second stage gas source. By introducing the first stage output at a point relatively close to the second stage outlet, device 110 will first release a relatively hot gas containing any fire suppressing species produced in the first stage gas source, followed by cooler and then refrigerating gas outputs. In contrast, by introducing the output from the first stage source at a location within the second stage gas source at a distance from the second stage outlet, the relatively cold gas produced by the vaporization of the liquified gas will be initially released, followed by increasing amounts of the relatively hot gases from the first stage gas source. Both sequences have value in fire fighting, depending on the specific application and type of fire.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

What is claimed is:

1. A gas generating device, adapted for producing a sufficient quantity of a gaseous fire suppressing material to substantially suppress a fire, the device comprising:

a first stage gas source containing a pyrotechnic, gas generating, fire suppression composition, which, upon combustion, produces a fire suppressing gas, and, optionally, a pressurized gas; wherein the pyrotechnic, gas generating, fire suppression composition comprises an inorganic halogen-containing component, an organic binder system, and at least one elemental halogen.

2. The gas generating device of claim 1, wherein the at least one elemental halogen is elemental iodine or elemental bromine.

3. The gas generating device of claim 1, wherein the halogen is coated or encapsulated with a protectant material adapted to prevent reaction with the pyrotechnic composition.

4. The gas generating device of claim 1, wherein the inorganic halogen-containing compound is present in an amount of from about 70 to 96 weight percent and the organic binder system is present in an amount of from about 4 to 30 weight percent, based on the total weight of the pyrotechnic composition.

5. The gas generating device of claim 1, wherein the inorganic halogen-containing component is selected from the group consisting of potassium bromide, potassium bromate, potassium iodide, potassium iodate, ammonium bromide, ammonium bromate, ammonium iodide, ammonium iodate, and mixtures thereof.

6. The gas generating device of claim 1, wherein the organic binder has a heat of formation of less than about 200 cal/g, and wherein the pyrotechnic fire suppression composition is solid at a temperature below 100° C., when cured, and combusts at a temperature between about 160° C. to 1200° C. to produce one or more reaction products that suppress fire.

7. The gas generating device of claim 6, wherein the reaction products comprise at least one of $H_2O$, CO, Kl, KBr, $H_2$, $COH_2$, $O_2$, $I_2OH$, $K_2l$, and mixtures thereof.

8. The gas generating device of claim 1, wherein the organic binder system comprises a binder resin of at least one curing binder, melt cast binder, solvated binder, and a mixture thereof, a curative present in about 1 to 3 weight percent, and a plasticizer present in about 10 to 30 weight percent, based on the total weight of the binder system, where the organic binder system has a heat of formation of less than about 200 cal/g.

9. The gas generating device of claim 8, wherein the binder resin is selected from the group consisting of carboxy-terminated polybutadiene, polyethylene glycol, polypropylene glycol, hydroxy-terminated polybutadiene, polybutadiene acrylonitrile, polybutadiene acrylic acid, butacene, glycol azido adipate, polyglycol adipate, and mixtures thereof.

10. The gas generating device of claim 8, wherein the organic binder system further comprises at least one of a curing or bonding agent, an antioxidant, an opacifier, and a scavenger.

11. The gas generating device according to claim 1, further comprising a second stage gas source in fluid communication at a first location with the first stage gas source, the second stage gas source comprising an outlet, and containing at least one liquified gas or supercritical carbon dioxide;

wherein the first stage gas source is capable of directing a sufficient quantity of gas at a sufficiently high temperature through an outlet therein and into the liquefied gas or supercritical carbon dioxide within the second stage gas source to vaporize at least a portion of the liquified gas or supercritical carbon dioxide in the second stage gas source, which vaporized gas then exits the second stage gas source through the second stage outlet and is directed at the fire.

12. The gas generating device of claim 11, wherein the liquified gas is carbon dioxide.

13. The gas generating device of claim 11, further comprising a halogen dissolved in the liquified gas or supercritical carbon dioxide.

14. The gas generating device of claim 13, wherein the halogen is elemental iodine.

* * * * *